United States Patent [19]

McMahon

[11] 4,373,494

[45] Feb. 15, 1983

[54] TREATMENT OF FLUID HYDROCARBON FUELS WITH ELECTRIC FIELDS

[75] Inventor: Roy C. McMahon, Kansas City, Mo.

[73] Assignee: Electrostatic Equipment Company, Kansas City, Mo.

[21] Appl. No.: 181,689

[22] Filed: Aug. 27, 1980

[51] Int. Cl.[3] ..... F02M 27/04

[52] U.S. Cl. ..... 123/538; 123/537

[58] Field of Search ..... 123/536, 537, 538, 539; 204/86, 136, 302

[56] References Cited

U.S. PATENT DOCUMENTS

| | | | |
|---|---|---|---|
| 1,358,031 | 11/1920 | Smith . | |
| 1,376,180 | 4/1921 | Wickersham | 123/538 |
| 1,455,088 | 5/1923 | McCabe . | |
| 2,926,276 | 2/1960 | Moriya . | |
| 3,116,726 | 1/1964 | Kwartz | 123/538 |
| 3,289,003 | 11/1966 | Jorgenson . | |
| 3,489,669 | 1/1970 | Ruhnke . | |
| 3,567,619 | 3/1971 | Brown . | |
| 3,577,336 | 5/1971 | Shirley . | |
| 3,697,411 | 10/1972 | Blomgren . | |
| 3,749,545 | 7/1973 | Velkoff . | |
| 3,761,062 | 9/1973 | King . | |
| 3,805,492 | 4/1974 | King . | |
| 3,830,621 | 8/1974 | Miller . | |
| 3,928,158 | 12/1975 | Fritsche | 204/302 |
| 3,989,017 | 11/1976 | Reece | 123/538 |
| 4,009,089 | 2/1977 | Crissman et al. | 204/302 |
| 4,073,273 | 2/1978 | McMahon | 123/538 |
| 4,073,712 | 2/1978 | Means . | |
| 4,173,206 | 11/1979 | Masaki | 123/538 |
| 4,246,082 | 1/1981 | Feuerman | 204/136 |

FOREIGN PATENT DOCUMENTS

| | | | |
|---|---|---|---|
| 2921498 | 6/1979 | Fed. Rep. of Germany | 123/538 |

*Primary Examiner*—Ronald H. Lazarus

*Attorney, Agent, or Firm*—Litman, Day and McMahon

[57] ABSTRACT

A method and apparatus are provided for treating fluid hydrocarbon fuels. The method includes flowing the fuel through a treater region defined by the apparatus including a cylindrical outer electrode positioned coaxially about an insulated inner electrode. The annular treater region is preferably filled with small dielectric beads of a selected size and having spaces therebetween of a selected size. Also, in the preferred embodiment, the electrodes are connected across the high voltage ignition circuit of a motor, such a motor thereafter consuming the treated fuel, to thereby establish a high intensity electric field within the treater region.

17 Claims, 5 Drawing Figures

TREATMENT OF FLUID HYDROCARBON FUELS WITH ELECTRIC FIELDS

FIELD OF THE INVENTION

The present invention relates to improvements in treaters for fluid hydrocarbon fuels and, more particularly, to such a treater through which the fuel flows during treatment within a high intensity field and which is filled with dielectric beads.

BACKGROUND OF THE INVENTION

It has become increasingly important to conserve hydrocarbon fuels, particularly gasoline. Therefore, it is desirable to optimize the combustion of such fuels.

It has been discovered that the passage of such fuel through a high intensity electric field prior to entrance into an engine results in a decrease in certain emissions from the exhaust gases and an increase in the energy output per unit of fuel consumed.

Also in the development of such a treater, it was discovered that filling the treating region of the treater with dielectric beads of a given size enhances the effect of the treater on the fuel, such that noticeable gains in combustion efficiency are achieved.

OBJECTS OF THE INVENTION

The principal objects of the present invention are: to provide a method of treating hydrocarbon fuels which increases the combustion efficiency of the fuel; to provide such a method including flowing the fuel through a treater filled with dielectric beads and having a high intensity electric field therein; to provide a treater apparatus for practicing such a method; to provide such a treater apparatus including a pair of coaxial electrodes defining an annular treating region therebetween through which the fuel flows; to provide such a treater filled with glass beads preferably spherical and having a diameter in the nature of about four millimeters; to provide such a treater which is adaptable for installation in an automobile to treat gasoline before entrance into the engine thereof; to provide such a treater in which the electric field is established by connection of the treater electrodes to a high voltage ignition circuit, preferably a spark plug wire, of the automobile; to provide such a treater which is adaptable for treating both gaseous and liquid fuels; and to provide such a treater which is economical to manufacture, durable and efficient in operation, and which is particularly well adapted for the intended usage thereof.

Other objects and advantages of the present invention will become apparent from the following description taken in connection with the accompanying drawings wherein are set forth, by way of illustration and example, certain embodiments of the present invention.

The drawings constitute a part of the specification, include an exemplary embodiment of the present invention, and illustrate various objects and features thereof.

DETAILED DESCRIPTION OF THE PREFERRED EMBODIMENTS

Figure 1:
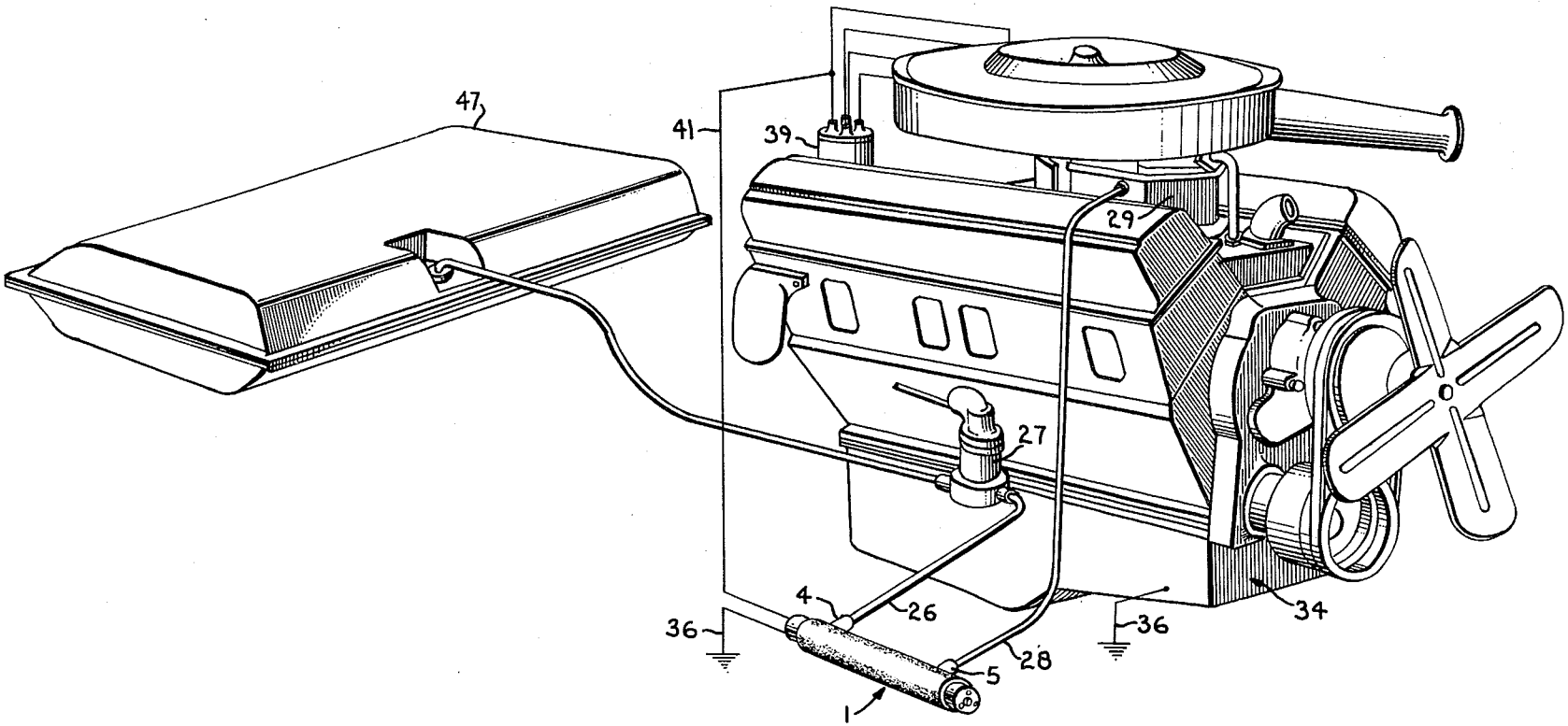
FIG. 1 is a perspective view of a treater according to the present invention shown connected within the fuel line of an automotive engine.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

In the embodiment shown in FIGS. 1 through 4, the reference numeral 1 generally designates a treater for the treatment of combustion engine burning fuels by passing same through a high intensity electric field. The treater 1 generally includes an elongated cylindrical inner electrode assembly 2 positioned coaxially within an elongated cylindrical outer electrode assembly 3. The outer electrode assembly 3 includes an inlet fitting 4 and an outlet fitting 5 communicating with an annular treater cavity or region 6 defined between the electrode assemblies 2 and 3. The annular treater region 6 is illustrated as filled with dielectric particles or glass beads 8.

Figure 2:
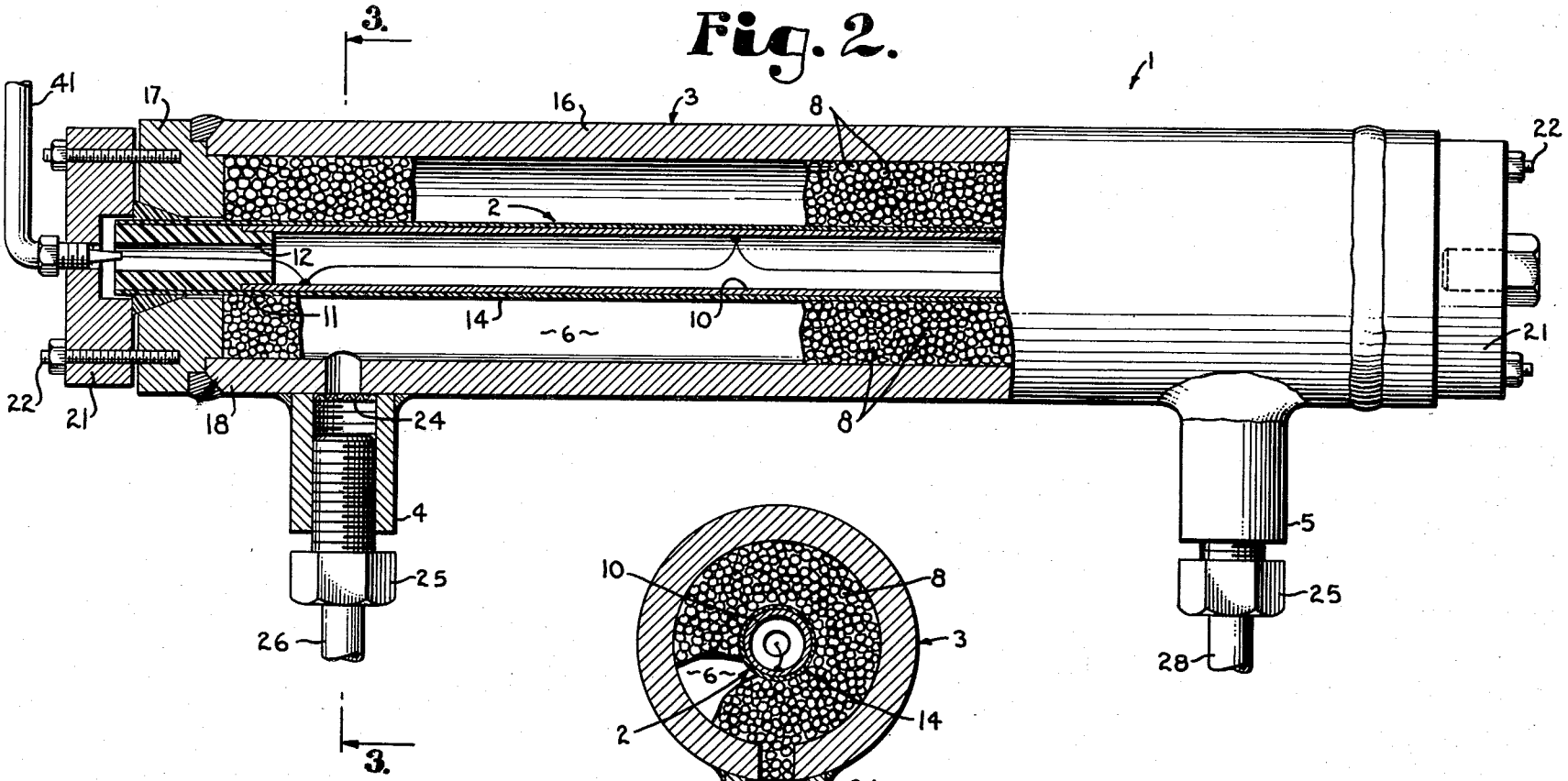
FIG. 2 is an enlarged side elevational view of the treater with portions broken away to illustrate internal details thereof.
Figure 3:
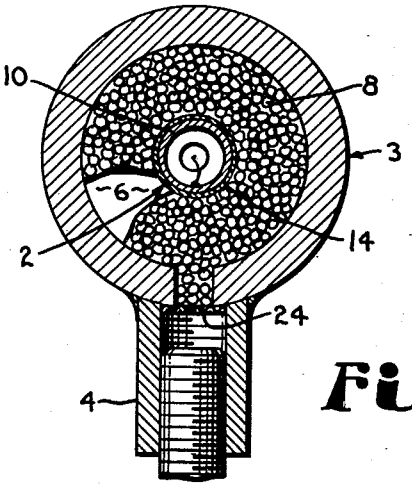
FIG. 3 is a transverse sectional view of the treater taken along line 3—3 of FIG. 2.
Figure 4:
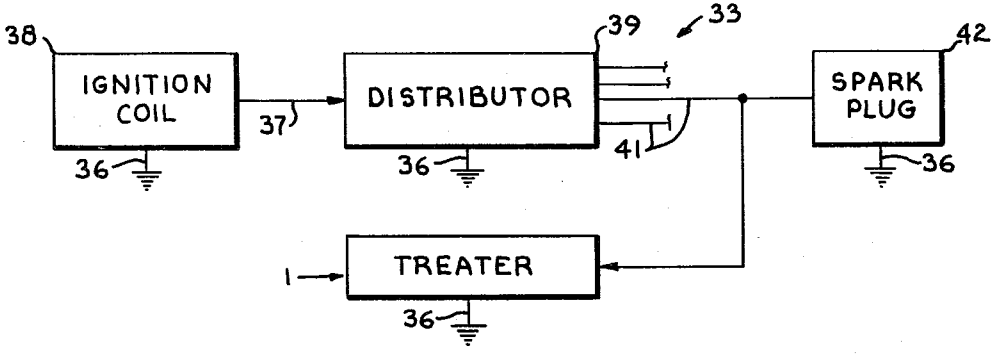
FIG. 4 is a block diagram showing connection of the treater to a high voltage ignition circuit associated with the automobile engine.

Referring to FIG. 2, the inner electrode assembly 2 includes an elongated conductive inner electrode member 10. Opposite ends 11 (one side not shown) of the inner electrode member 10 each receive a dielectric spacer 12 therein. The inner electrode member 10 is encased in a dielectric sheath 14 which insulates the electrode member 10 from the fuel during treatment. Preferably, the sheath 14 is formed of a material such as tetrafluoroethylene or the like which is marketed under the trademark Teflon.

The outer electrode assembly 3 includes a conductive cylindrical shell or electrode member 16 having an inwardly directed flange 17 at opposite ends 18 thereof. The inner electrode assembly 2 is positioned coaxially within the outer electrode assembly 3 by placement of the spacers 12 through the flanges 17 with resilient circumferential wedgeshaped seals 20 interposed between the flanges 17 and the spacers 12. End caps 21 are received on the ends of the outer electrode assembly 3 and are brought to bear against the wedge seals 20 by tightening fasteners 22 extending through the end caps 21. The seals 20 provide a fluid tight connection to prevent leakage from the treater 1.

The inlet 4 and outlet 5 are each provided with a screen or gate 24 to prevent the beads 8 from flowing out of the treater 1. The inlet 4 and outlet 5 may be threaded to receive suitable fuel line connectors 25 for connection of a fuel line 26 from a fuel pump 27 (FIG. 1) to the inlet 4 and a fuel line 28 from the outlet 5 to a carburetor 29.

The electric field within the treater 1 may be established by connection of the electrode members 10 and 16 to any DC high voltage supply 32. In the preferred embodiment, the electrode assemblies 2 and 3 are connected across a high voltage ignition circuit 33 (FIG. 4) of an automotive motor 34 which is to consume the fuel after passing through the treater 1. For reasons of safety, the inner electrode member 10 is preferably connected to the "hot" side of the ignition circuit 33, while the shell or outer electrode member 16, which is exposed, is connected to a ground 36 associated with the ignition circuit 33. The inner electrode member 10 may be connected to a conductor 37 connecting an ignition coil 38 to a distributor 39. However, it is generally more convenient, and therefore preferable, to connect the inner electrode member 10 to one of several spark plug wires 41 leading from the distributor 39 to spark plugs 42 associated with the automotive engine 34. The treater 1 draws a negligible amount of current; therefore, connection to one of the spark plug wires 41 does not deteriorate performance of the spark plug 42 to which the treater 1 is connected.

Figure 5:
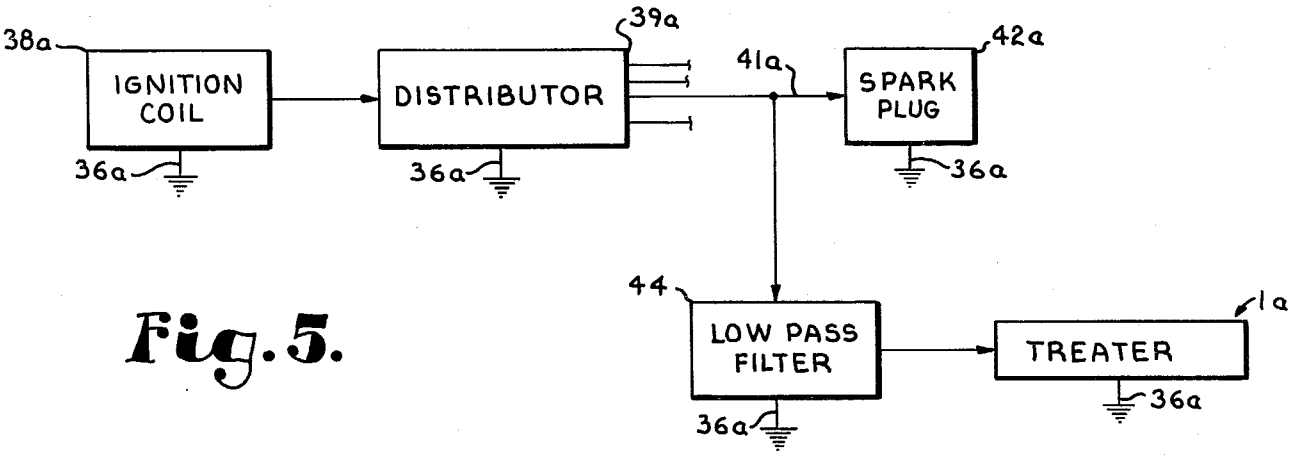
FIG. 5 is a view similar to FIG. 4 of a modified embodiment of a treater showing an electric filter connected between a treater and an ignition circuit.

Under some circumstances, depending on the size of the treater 1, type of fuel under treatment, flow rate, and other considerations, it is desirable to filter the time varying voltage of the ignition circuit 33 to a substantially constant DC voltage. A modified embodiment of a circuit 33*a* associated with a treater 1*a* is illustrated in FIG. 5. The circuit 33*a* is essentially the same as the previous circuit 33 except that a low pass filter 44 is interposed between the source of ignition voltage and the treater 1. As the other elements of circuit 33*a* are the same as the previous circuit 33, such elements are numbered the same with the addition of the suffix "a" to the former. The filter 44 may consist of a suitably sized capacitor (not shown), may include a diode (not shown) to prevent unwanted discharge from the capacitor, and may include other conventional filter components.

The treater 1 is particularly well adapted for use in treating fuel such as gasoline or the like during passage thereof between a gas tank 47 and the carburetor 29 associated with the engine 34 and prior to combustion of the fuel in the engine 34. The treater 1 for use in a conventional passenger automobile may have the following dimensions: the inner electrode member 10 would be approximately one half inch in diameter and about seven inches long; the sheath 14 would be about 0.020 inches thick; the shell 16 would have an inner diameter of about 2.5 inches; the overall length of the treater would be about ten inches and the outer diameter would be about three inches; and the glass beads 8 would have a diameter of about four millimeters. The connection of the treater 1 to the ignition circuit 33 of the engine 34 is particularly convenient and economical since a separate power supply 32 does not have to be provided although it is foreseen that a separate power supply could be utilized for this purpose. It is also foreseen that the treater 1 could draw directly from an ignition or spark coil or the like which would provide suitable high voltage sufficient to form the electric field in the treater 1.

The precise mechanism which causes changes in the treated fuel is not fully understood. One suggestion which is theoretical and to which applicant does not wish to be held is that the electric field causes a finer atomization in the carburetor 29 which provides for more complete combustion of the fuel in the cylinders. The optimum size of the beads 8 was arrived at by empirical means. The effects of the beads 8 is believed to be a surface phenonenon associated with a change on the surface of the beads 8 engaging the fuel in the treater 1 which charge is believed to be developed in the electrical field developed in the treater 1. It is believed that the charge on the beads is similar to a charge on one or both of the fuel engaging surfaces of the electrode assemblies 2 and 3. It is also believed that as the beads 8 get smaller such that the total surface area thereof increases, then the charge increases, however, below approximately four millimeters diameter additional decrease in size appears to not improve the treatment and may hinder same as compared to treatment with beads 8 of four millimeters. The space between adjacent beads 8 is also believed to be important as passageways are formed in such spaces to allow flow of fuel through the treater 1. However, the present invention is not to be limited to a particular size, shape, or dielectric material of the beads 8 and it is foreseen that numerous conventional packing with high surface area associated therewith could be utilized.

In tests conducted by operating an automobile at a speed of 55 miles per hour on a dynamometer, the following results were obtained: a reduction of carbon monoxide percentage in the exhaust from 0.3% without the treater 1 to 0.24% with the treater 1 in operation; and a reduction in hydrocarbon emissions from 90 parts per million (ppm) without the treater 1 to 40 ppm with the treater 1. During informal mileage tests with the same automobile and treater 1, increases in miles per gallon in the nature of 20% were achieved.

The treater 1 has been described principally in terms of treating gasoline for use in passenger automobiles. However, with suitable modifications, it is projected that the method and apparatus according to the present invention would be applicable to the treatment of other hydrocarbon fuels, both gaseous and liquid, for use in various other types of engines and heat sources. In particular the fuel may include but is not limited to methane, propane, butane, gasoline, ethanol, diesel fuel and the like.

It is noted that while the charge applied to the treater by a conventional automobile ignition circuit is fairly uniform throughout various models, it is foreseen that one having ordinary skill in the art could apply a fairly wide range of charges to the treater from other sources. In particular a D.C. voltage in range of 5,000 to 30,000 volts is preferred, however, other voltage would also produce a suitable field.

While certain forms of the present invention have been described and illustrated, it is not to be limited thereto except insofar as such limitations are included in the following claims.

What is claimed and desired to be secured by Letters Patent is:

1. In combination with an internal combustion engine and a fuel source, a treater for treating a liquid hydrocarbon fuel to be combusted in said engine; said treater being fuel flow positioned between said fuel source and said engine so as to improve the combustion efficiency of the fuel; said treater comprising the combination of:

(a) an elongated conductive inner electrode;

(b) an elongated conductive cylindrical outer electrode positioned substantially coaxially about said inner electrode to define an elongated annular treater region therebetween;

(c) a dielectric covering on at least one of said electrodes to insulate said one of said electrodes from said fuel during treatment;

(d) fluid connection means at opposite ends of said outer electrode and communicating with said treater region, one of said fluid connection means being for connection to said fuel source and the other of said fluid connection means for connection to said engine;

(e) a plurality of dielectric particles positioned within said treater region;

(f) means retaining said dielectric particles within said treater region;

(g) high voltage supply means connected to said electrodes to provide a high intensity electric field between said electrodes within said treater region for treatment of fuel flowing therethrough to said engine.

2. The combination as set forth in claim 1 wherein:

(a) said high voltage supply means is the high voltage ignition circuit of said engine.

3. The combination as set forth in claim 1 wherein:

(a) said dielectric particles are substantially spherical glass beads, each of said beads having a diameter in the nature of four millimeters.

4. The combination as set forth in claim 1 wherein said annular treater region has:

(a) an inner diameter of approximately one half inch (1.27 cm.);

(b) an outer diameter of approximately two and one half inches (6.35 cm.); and (c) a length of approximately seven inches (17.78 cm.).

5. In combination:

(a) an internal combustion engine;

(b) fuel storage means supplying a liquid hydrocarbon fuel to said engine for combustion therein;

(c) high voltage ignition circuit means cooperating with said engine to ignite said fuel within said engine; and (d) a treater positioned in fluid communication between said fuel storage means and said engine for treating said fuel prior to entry into said engine to improve the combustion efficiency of said fuel; said treater comprising:

(1) electrode means defining a treater region in fluid communication with said fuel line and said engine for the flow of fuel through said treater region;

(2) said electrode means being connected to said ignition circuit means to provide a high intensity electric field within said treater region; and (3) a plurality of dielectric particles retained within and substantially filling said treater region.

6. The combination as set forth in claim 5 wherein:

(a) said dielectric particles are substantially spherical glass beads, each of said beads having a diameter in the nature of four millimeters.

7. The combination as set forth in claim 5 wherein:

(a) said treater region is elongated and annular; and (b) said treater region has the dimensions of:

(1) an inner diameter of approximately one half inch (1.27 centimeters);

(2) a outer diameter of approximately two and one half inches (6.35 centimeters); and (3) a length of approximately seven inches (17.78 centimeters).

8. In an internal combustion engine system including the following: a reciprocating internal combustion engine adapted for operation on gaseous fuel and having a carburetor associated therewith, means connected to said engine and including a power supply directing a fuel modifying electrostatic field of about 6,000 to 14,000 volts across said gaseous fuel prior to the formation of a combustible mixture in said carburetor for use in said engine, said means including an inner metallic cylinder and an outer metallic cylinder forming a passageway therebetween for said fuel and across which passageway said field is directed, said inner metallic cylinder having an insulating coating thereover to reduce the tendency for electric discharge across said passageway, said carburetor being operably located between said means and said engine whereby the fuel is treated by said means prior to carburetion; the improvement comprising:

(a) a plurality of dielectric particles positioned within said passageway and allowing flow of said fuel through said passageway.

9. The system according to claim 8 wherein:

(a) said particles are spherical glass beads having a diameter in the nature of four millimeters.

10. The system according to claim 8 or 9 wherein:

(a) said passageway has an inner diameter of approximately one half inch and an outer diameter of approximately two and one half inches.

11. A method for treating a fluid hydrocarbon fuel immediately prior to use of the fuel in an internal combustion engine comprising the steps of:

(a) flowing said fuel into a treater region of a treater;

(b) producing a high intensity electric field in said treater region;

(c) filling said treater region with dielectric particles of a selected size and of a shape to provide fuel passages in the space between said particles;

(d) flowing said fuel through said passages between said particles in the presence of said high intensity electric field; and (e) utilizing said fuel in an internal combustion engine substantially immediately after flowing said fuel through said particles in the presence of said high intensity electric field.

12. A method as set forth in claim 11 wherein:

(a) said dielectric particles are glass beads.

13. A method as set forth in claim 11 wherein:

(a) said dielectric particles are substantially spherical glass beads having a diameter of approximately four millimeters.

14. A method as set forth in claim 11 including:

(a) providing a pair of electrode means to form said treater region; and (b) connecting said pair of electrode means across a high voltage ignition circuit of said engine which consumes the treated fuel.

15. A method as set forth in claim 11 wherein said treater includes:

(a) an elongated cylindrical conductive inner electrode;

(b) insulation means surrounding said inner electrode to insulate same from said fuel during treatment thereof;

(c) an elongated conductive cylindrical outer electrode positioned substantially coaxially about said inner electrode thereby defining an elongated annular treater region therebetween;

(d) fluid connection means at opposite ends of said outer electrode communicating with said treater region to allow flow of said fuel therethrough; and (e) means connecting a source of high voltage to said inner and outer electrodes to establish said high intensity electric field in said treater region.

16. A method as set forth in claim 15 wherein:

(a) said dielectric particles are substantially spherical glass beads having a diameter of approximately four millimeters.

17. The combination as set forth in claim 1 wherein:

(a) said inner electrode is insulated from said fuel by a dielectric covering thereon;

(b) said inner electrode is adapted to be connected to a spark plug wire of the high voltage ignition circuit of said engine which consumes said treated fuel after treatment by said treater; and (c) said outer electrode is connected to a circuit ground of said ignition circuit.

* * * * *